US006099923A

United States Patent [19]

Kitei

[11] Patent Number: 6,099,923

[45] Date of Patent: Aug. 8, 2000

[54] NON-STICK COATING FOR THE THREADS OF A STORAGE CONTAINER OF A LIQUID WHICH HARDENS WHEN DRY

[76] Inventor: Robert Kitei, 4631 Dickinson Way, Doylestown, Pa. 18901

[21] Appl. No.: 09/047,134

[22] Filed: Mar. 24, 1998

[51] Int. Cl.[7] ..... B65D 81/00; A45D 29/12

[52] U.S. Cl. ..... 428/34.4; 428/35.7; 428/419; 428/422; 215/12.2; 215/44; 215/329; 220/288; 132/75

[58] Field of Search ..... 428/34.4, 35.7, 428/36.92, 419, 421, 422, 426, 442, 441; 132/73, 73.5, 75; 401/126, 127, 128, 129, 269; 424/61; 220/288; 206/581, 229, 823, 209; 215/329, 44, 12.1, 12.2

[56] References Cited

U.S. PATENT DOCUMENTS

| | | | |
|---|---|---|---|
| 3,047,417 | 7/1962 | Melrose | 117/37 |
| 3,074,548 | 1/1963 | Parks | 206/84 |
| 3,179,290 | 4/1965 | Whitney | 222/1 |
| 3,423,234 | 1/1969 | Heine | 117/124 |
| 3,682,345 | 8/1972 | Baugh | 215/43 R |
| 3,958,073 | 5/1976 | Trevisan et al. | 428/427 |
| 4,130,675 | 12/1978 | Vassiliou et al. | 427/333 |
| 4,131,552 | 12/1978 | Marcantonio | 252/29 |
| 4,285,378 | 8/1981 | Wallace | 411/258 |
| 4,396,658 | 8/1983 | Mettes et al. | 428/36 |
| 4,546,141 | 10/1985 | Gebauer | 524/401 |
| 4,710,409 | 12/1987 | Lahaye | 427/421 |
| 4,733,788 | 3/1988 | D'Amico | 215/295 |
| 4,850,300 | 7/1989 | Kraft et al. | 118/63 |
| 5,240,775 | 8/1993 | Tannenbaum | 428/422 |
| 5,547,759 | 8/1996 | Chen et al. | 428/421 |
| 5,562,991 | 10/1996 | Tannenbaum | 428/421 |

FOREIGN PATENT DOCUMENTS 2291915 11/1974 France .

OTHER PUBLICATIONS

Derwent Abstract of FR2,291,915; Astra Plastique, 1974.

*Primary Examiner*—Ellis Robinson
*Assistant Examiner*—John Figueroa
*Attorney, Agent, or Firm*—Ratner & Prestia

[57] ABSTRACT

A storage container for containing liquids that harden, that comprises a threaded surface and a closure having threading complimentary to the threads of the storage container, wherein the threads of the threaded surface are coated with a non-stick coating to prevent the liquid from hardening on the threads of the container and bonding the closure with to the container.

16 Claims, 8 Drawing Sheets

NON-STICK COATING FOR THE THREADS OF A STORAGE CONTAINER OF A LIQUID WHICH HARDENS WHEN DRY

FIELD OF THE INVENTION

The present invention relates to non-stick coating applied to the threads of a storage container, such as a bottle. More specifically, the present invention relates to a non-stick coating applied to the threads of a nail polish bottle to prevent the screw cap closure from bonding to the threads by nail polish which hardens between the threads of the nail polish bottle and the threads of the screw cap closure for the nail polish bottle.

BACKGROUND OF THE INVENTION

Nail polish and many paints are chemical compounds which include one or more aromatic hydrocarbons as a principle ingredient. Although sold in many different package shapes, nail polish is almost universally sold in small glass jars. Many paints, including hobby craft and modeling paints are sold in small glass jars, as well.

The small glass jars of this standard package have a threaded neck which is fitted with a plastic screw cap closure, having complimentary threads to that of the small glass jar or bottle. An applicator, such as a small brush tip attached to a stick, is usually permanently mounted to the inside of the screw cap closure in a manner to allow the applicator to be fitted within the small glass jar when the screw cap closure is screwed closed onto the small glass jar.

In applying the nail polish it is customary to dip the applicator brush into the nail polish bottle and wipe off excess polish on the lip of the nail polish bottle, so that the nail polish falls back into the bottle. In actual practice, however, the nail polish often fails to completely fall back into the bottle. Varying amounts of the excess nail polish often rolls down the threads of the bottle, remaining on the threads. In addition, when the applicator brush is inserted into the nail polish bottle for storage, the applicator brush and stick often become coated with nail polish. When the cap is removed and inverted to begin applying the nail polish, some of the polish may run down the stick and into the inner cavity of the screw cap closure. When the closure is resealed, the nail polish contained inside the closure can run down the threads of the screw cap closure between the closure threads and the bottle threads. Some of the nail polish may remain between the two sets of threads.

Whether applied to one's fingernails or the threads of a nail polish bottle/closure, nail polish hardens when its solvent evaporates into the air. If coated on the threads of the bottle/closure threads, the nail polish can harden in this position. The hardened nail polish acts like an adhesive, bonding the bottle and the closure together. This bond can be extremely strong and difficult to break open. At times, the bond can not be broken without damage to the plastic closure.

Because it is desirable to avoid smearing of one's nail polish after application, it is often inconvenient to effectively wipe clean the nail polish bottle threads and/or closure threads after one has applied nail polish to ones finger nails.

Non-stick coatings are coatings which are applied to a surface to prevent a substance from adhering to the surface. Some non-stick coatings work by providing an extremely smooth surface, without surface pockets or indentations, effectively reducing the coefficient of friction of the surface. A smooth surface can make it difficult for a substance such as nail polish, paint and some adhesives to bond with the surface.

An example of a non-stick coating is TEFLON®. TEFLON® is a trademark for tetrafluroethylene (TFE) fluorocarbon polymers or fluorinated ethylenepropylene (FEP) resins. TEFLON® is a well known non-stick coating which is commonly used on cookwear to prevent food from "sticking" to the surface of the cookwear. TEFLON® is also used on some tube type applicators for adhesives containing cyanoacrylate, to prevent the adhesive from blocking the applicator. One of the short comings of TEFLON® coatings is their lack of durability. TEFLON® is a relatively soft substance that can be easily scratched, scraped or otherwise marred. Teflon® tapes have been used in plumbing applications to achieve a secure, leak free fit between the threads of water or gas piping. These tapes are suited for a single use where the threaded pipes remain sealed or screwed together. If the pipes are unscrewed, it is often necessary to make a new tape application. In addition, in many cases the tape does not completely cover all surfaces of the threads, complete coverage of all threaded surfaces is not necessary to achieve the sealing purpose of the plumber's tape.

In some cases, the threads of the glass bottle tend to cause more adhesion with the hardening liquid than the closure. In such situations, the difficulty in removing the closure may be more a result of the expansion of the hardening liquid than from a bond formed with the bottle, closure and hardening liquid.

SUMMARY OF THE INVENTION

The present invention involves a storage container for containing liquids that harden, that comprises a threaded surface and a closure having threading complimentary to the threads of the storage container, wherein the threads of the threaded surface are coated with a non-stick coating to prevent the liquid from hardening on the threads of the container and bonding the closure with to the container.

BRIEF DESCRIPTION OF THE DRAWINGS

The present invention will not be described by way of non-limiting example, with reference to the attached drawings in which.

DETAILED DESCRIPTION OF THE INVENTION

Figure 1:
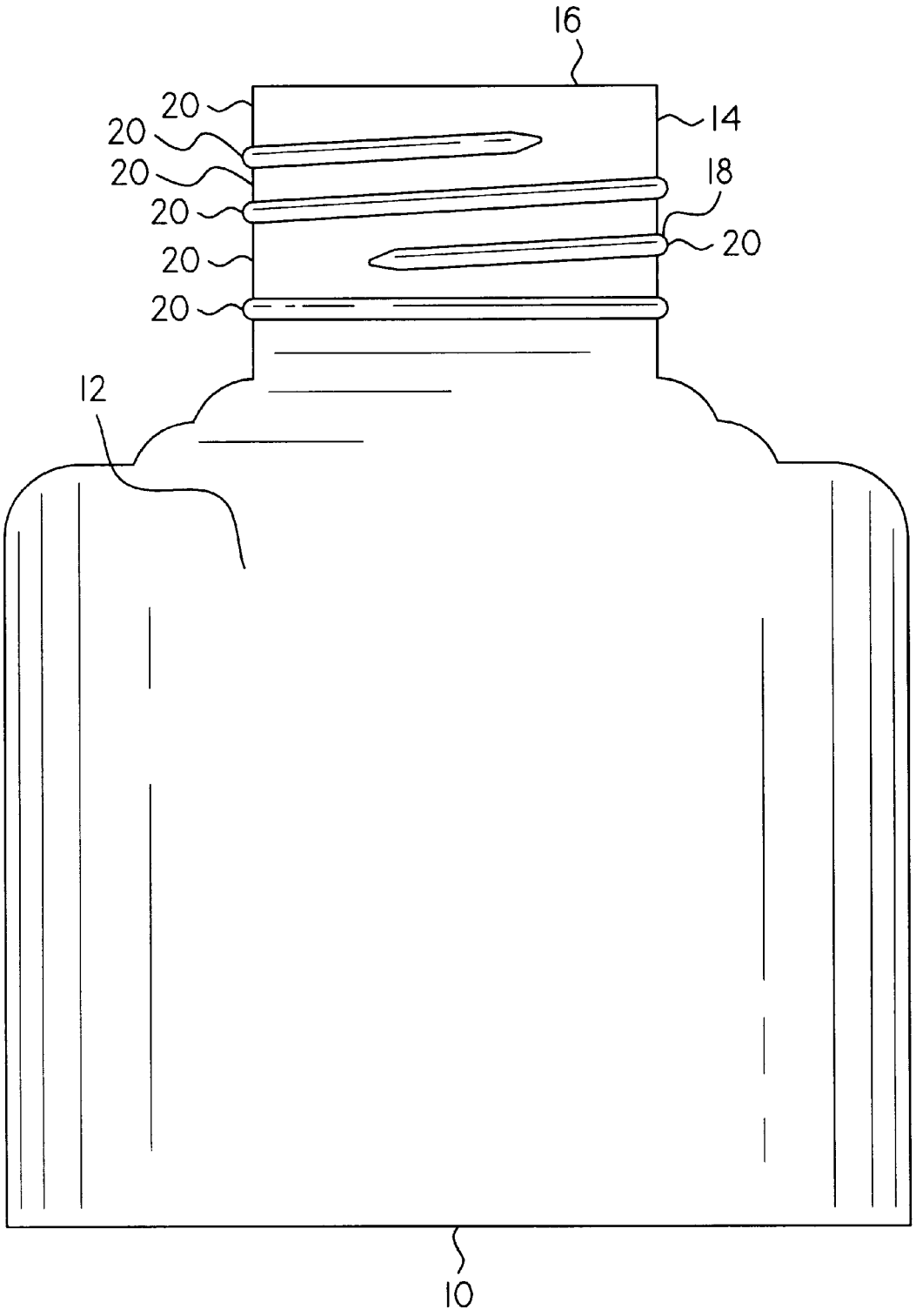
FIG. 1 is a plan view of a threaded bottle with a non-stick coating in accordance with the present invention.
Figure 2:
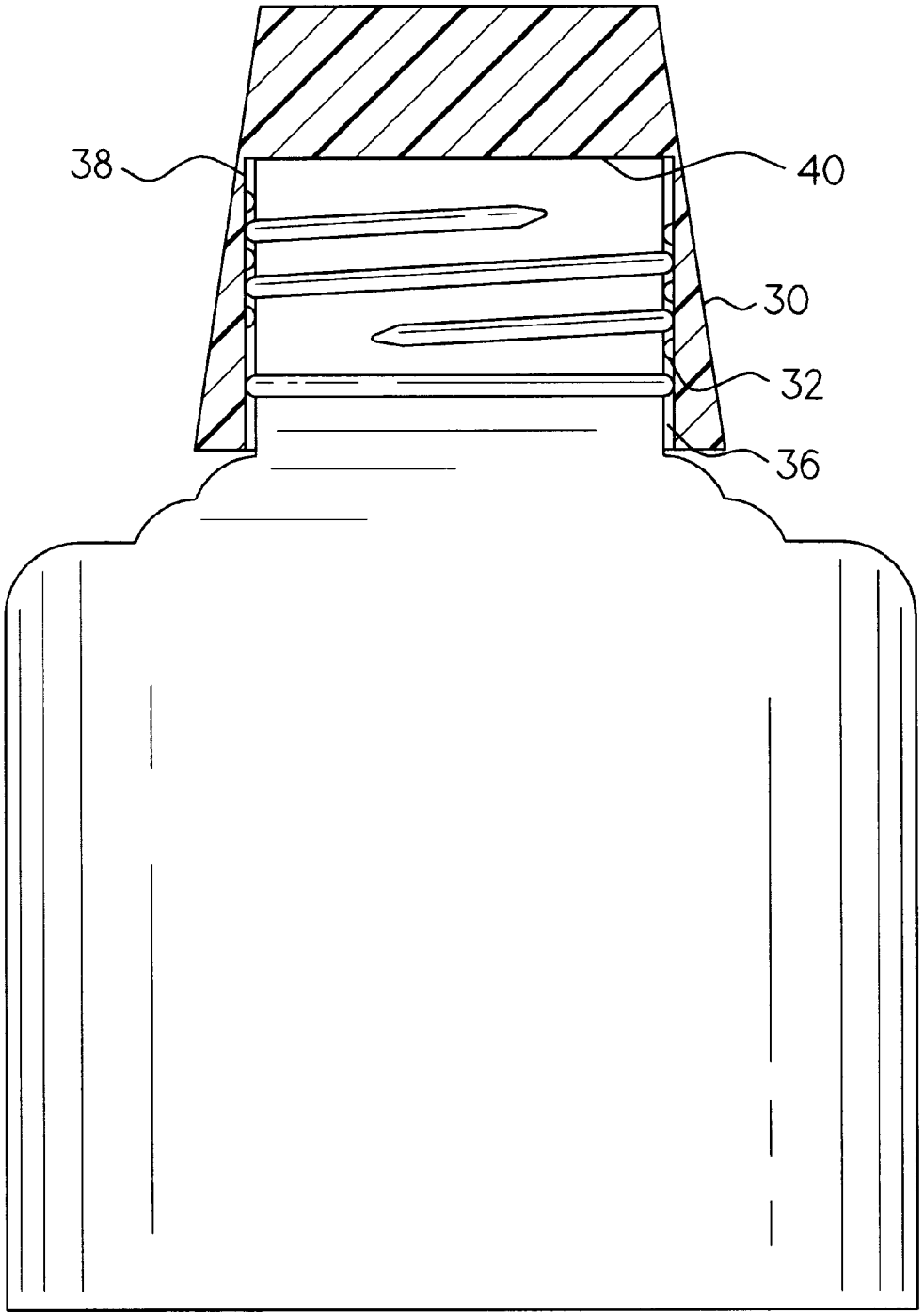
FIG. 2 is a cut away view of a closure for the bottle illustrated in FIG. 1.

There is shown in FIGS. 1 and 2 a threaded storage bottle 10 and complimentary screw cap closure 30 in accordance with the present invention. Bottle 10 is designed to store liquid chemical compounds which when dried or hardened can cause screw cap closure to become difficult to remove. Examples of such compounds include nail polish, paint and adhesives. For the examples described herein, the chemical compound will be described as nail polish and bottle 10 will be referred to as a nail polish bottle.

Nail polish is stored within central cavity 12 of bottle 10. Nail polish bottle 10 includes a neck 14 and a mouth 16. Neck 14 is substantially circular and has threads 18 disposed around its circumference. Other surfaces of nail polish bottle 10 do not contain threads 18, resulting in a threaded storage container that includes both threaded and non-threaded surfaces. A protective coating 20 is applied to neck 14 and threads 18 to prevent nail polish from bonding to the surface of neck 14 or threads 18. Coating 20 may be applied to all surfaces of neck 14 where there is a likelihood of nail polish hardening between bottle 10 and closure 30 to form an adhesive bond. To the extent that such a bond could be formed between another portion of bottle 10, other than neck 14 and closure 30, then coating 20 could be applied to that portion of bottle 10, as well. Such a situation could occur if closure 30 extends substantially beyond neck 14.

Closure 30 contains threads 32 which are complimentary to threads 18 of nail polish bottle 10. Closure 30 is designed to fit over neck 14, which fits within opening 36 of closure 30.

If any nail polish remains on threads 18 or threads 32 when closure 30 is mated with bottle 10, coating 20 will serve to prevent the nail polish from forming a bond with the threads or other surfaces of bottle 10 when the nail polish hardens. Accordingly, a greatly reduced amount of force is necessary to remove closure 30, if hardened nail polish is disposed between the respective threads of bottle 10 and closure 30, than if coating 20 was not present.

Figure 3:
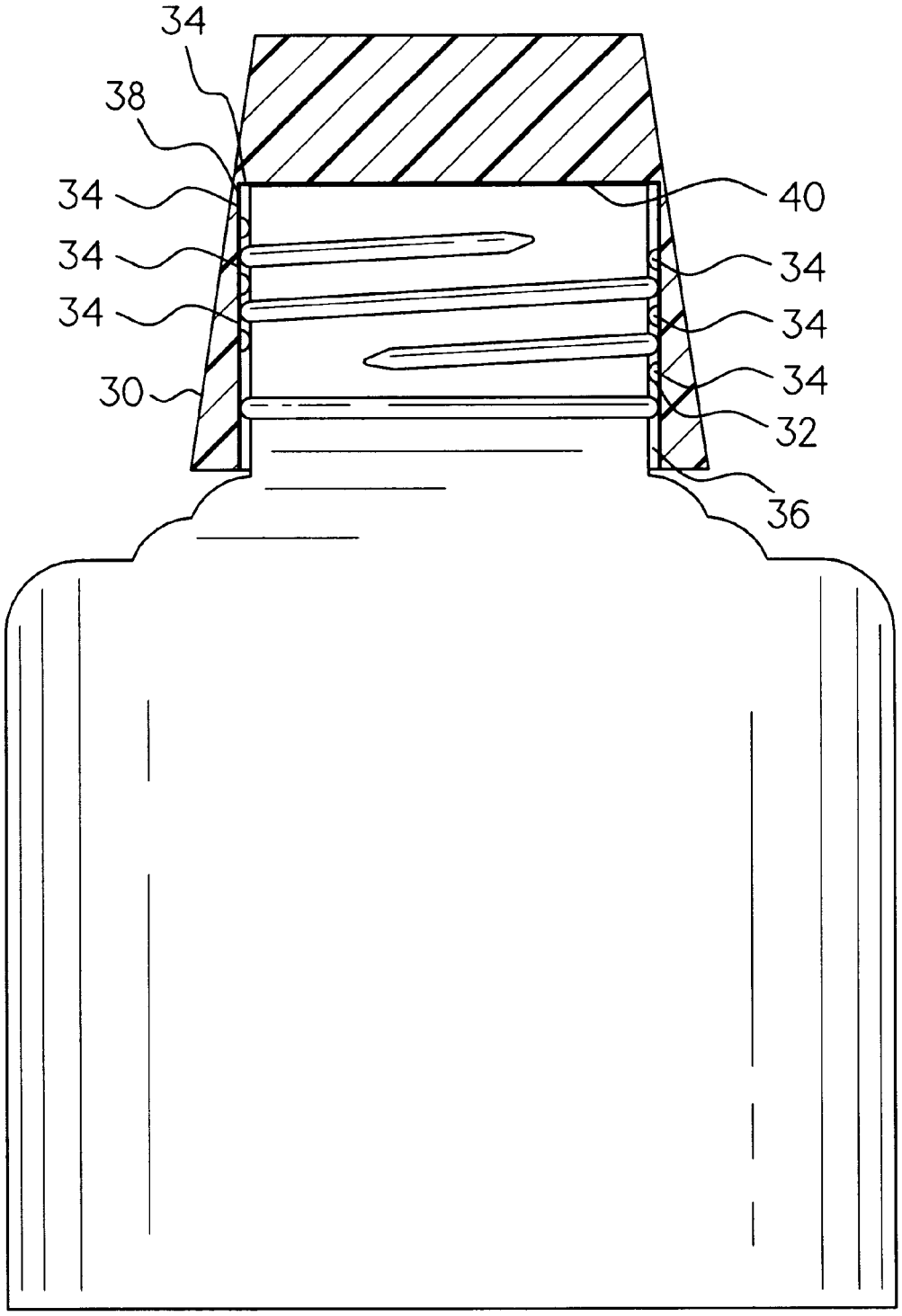
FIG. 3 is a cut away view of an additional embodiment of a closure for the bottle illustrated in FIG. 1.

In FIG. 3, an alternative embodiment for closure 30 is shown. A coating 34 is shown, applied to threads 32, as well as to the interior closure wall surface 38 between threads 32 and interior roof surface 40. This optional coating is designed to enhance the non-stick properties of the present invention by addressing the closure surfaces, in addition to the bottle surfaces, that are susceptible to adhesion with a substance, such as nail polish.

Figure 4:
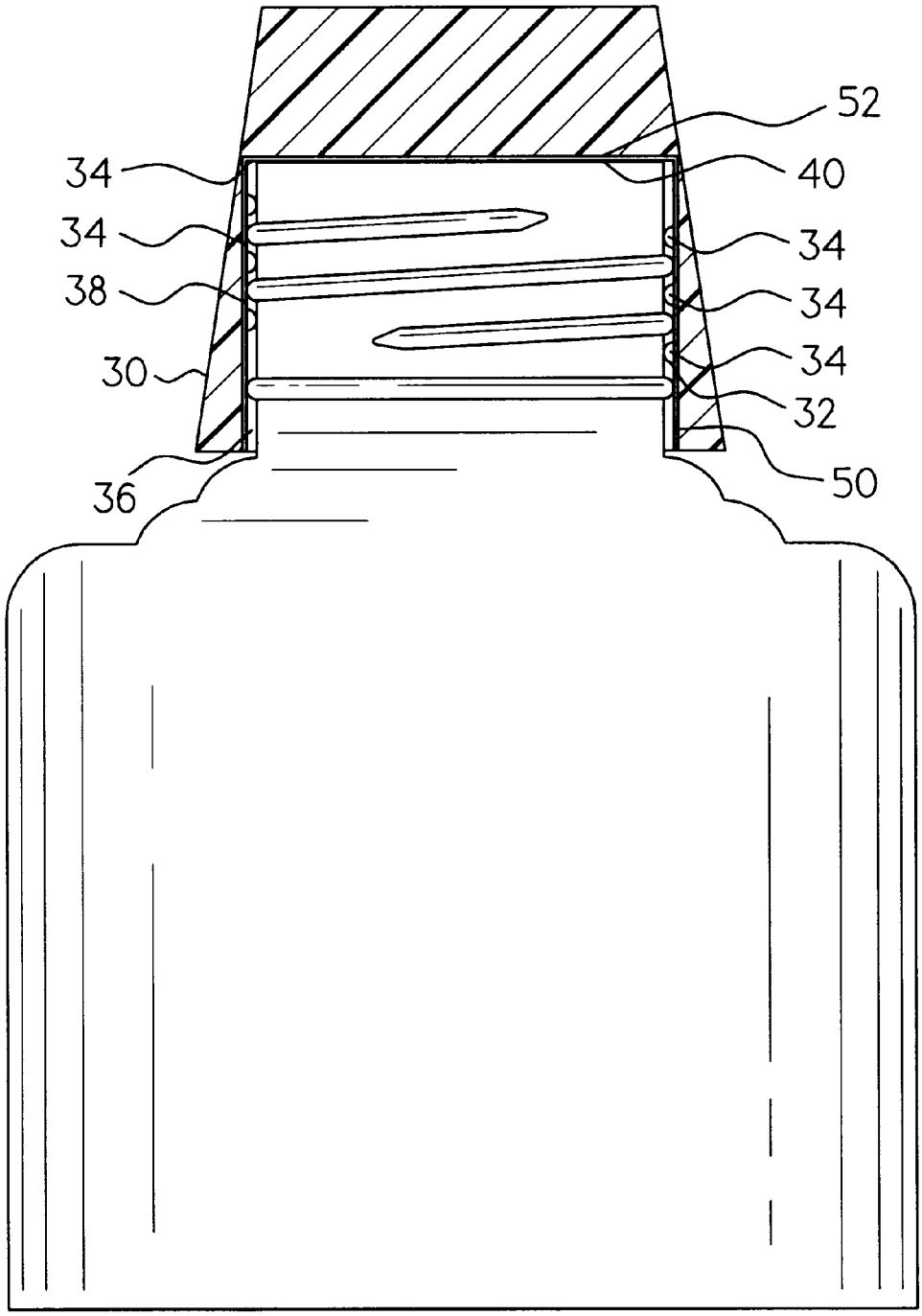
FIG. 4 is a cut away view of an additional embodiment of a closure for the bottle illustrated in FIG. 1.
Figure 5:
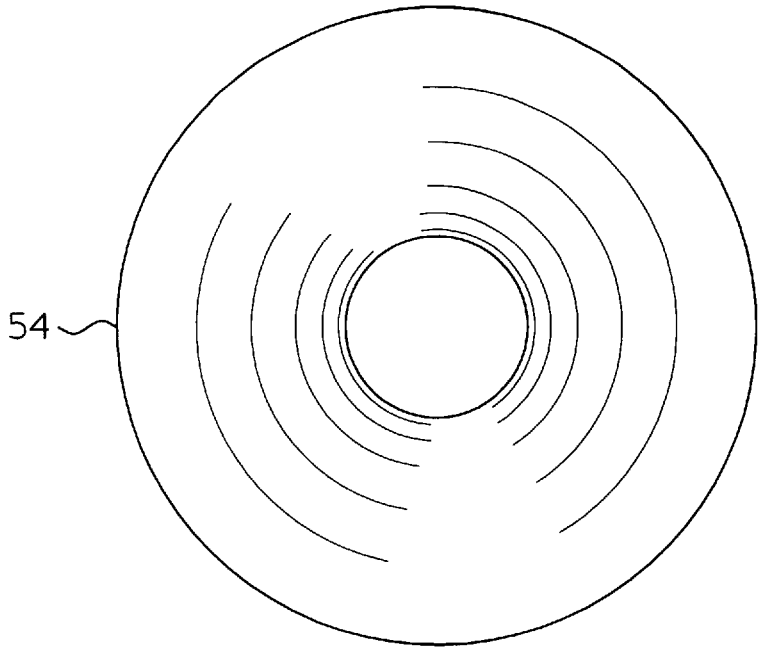
FIGS. 5–9 show additional exemplary embodiment of the invention.

In FIG. 4, an additional embodiment for closure 30 is shown. A coated insert 50 is permanently adhered to internal cavity 52 of closure 30. Insert 50 is manufactured separate from closure 30 and then inserted into cavity 52 of closure 30. A coating 34 is applied to insert 50 to cover internal wall surfaces 38 and roof surface 40 of insert 50. Insert 50 may be made of a material that is capable of being coated with coating 34. Example materials include, glass and plastic.

An example of coating 20 is polyphenylene sulfide, commonly sold under the trademark RYTON™ CT Series by Phillips Petroleum Company. This resin has non-stick and hardness properties which are desirable for bottle storage environments where chemical compounds such as nail polish, paint and adhesives are stored. In addition, this resin has no known solvents below 500° Fahrenheit. In an exemplary embodiment, a single coating of RYTON™ is applied to threads 18 of nail polish bottle 10 and cured at 725° Fahrenheit for 10 minutes. For surfaces where a hardened coating is not necessary, other softer, non-stick coatings, such as TEFLON® may be used as coating 20.

To enhance the non-stick properties of the present invention, an additional coating can be applied to threads 32 of closure 30. Because a polyphehylene sulfide resin such as RYTON™ requires such a high curing temperature, this coating would prove difficult to apply to a plastic surface such as that of a typical closure 30 for a nail polish bottle. Therefore a different type of non-stick coating, such as TEFLON® could be used.

In an additional embodiment, shown in FIGS. 5–8, a supplementary or retrofittable thread cover 54, that serves as a non-stick coating, can be used with bottle 10. Cover 54 is designed to fit over threads 18 of a bottle 10 that does not already have a coating 20 on threads 18. Cover 54 can also be used with a bottle 10 that has a damaged coating 20 already applied to threads 18. In operation, closure 30 can be sealed over cover 54, molding cover 54 to threads 18. Cover 54 should be of a thickness and softness to allow cover 54 to easily mold over threads 18, yet stay in place and not inhibit rotation of closure 30 when closure 30 is being removed and replace. Cover 54 has an opening to fit over the neck portion of bottle 10 and sections that fit over and cover threads 18 when fitted. In this embodiment, any liquid 12 that drips down threads 18 will be located on the outside surface of cover 54. Cover 54 thus becomes a coating 20.

Figure 6:
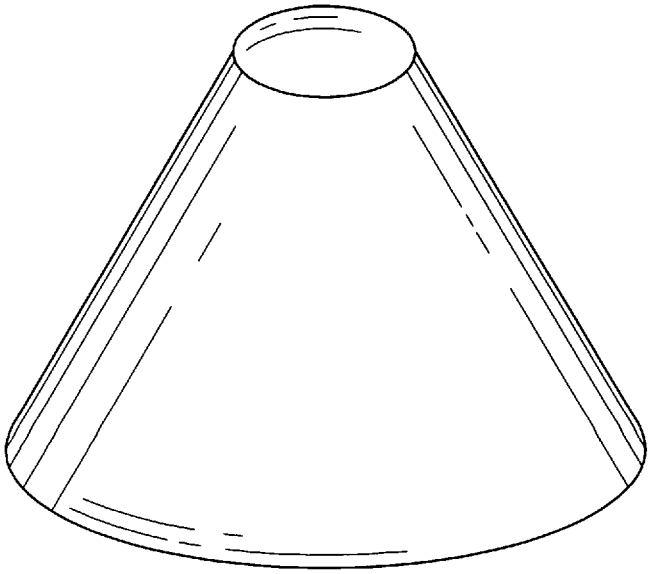
Figure 7:
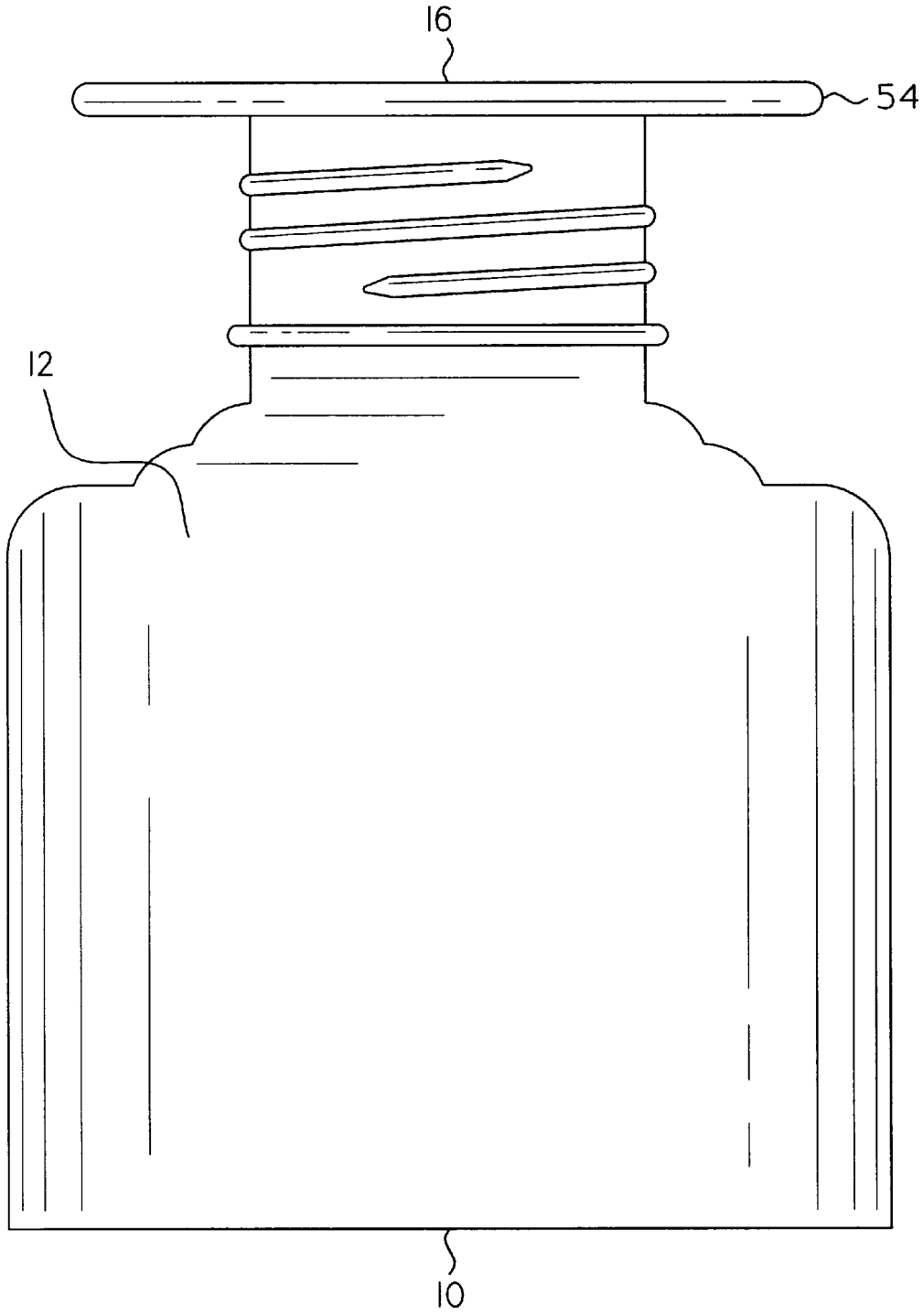
Figure 8:
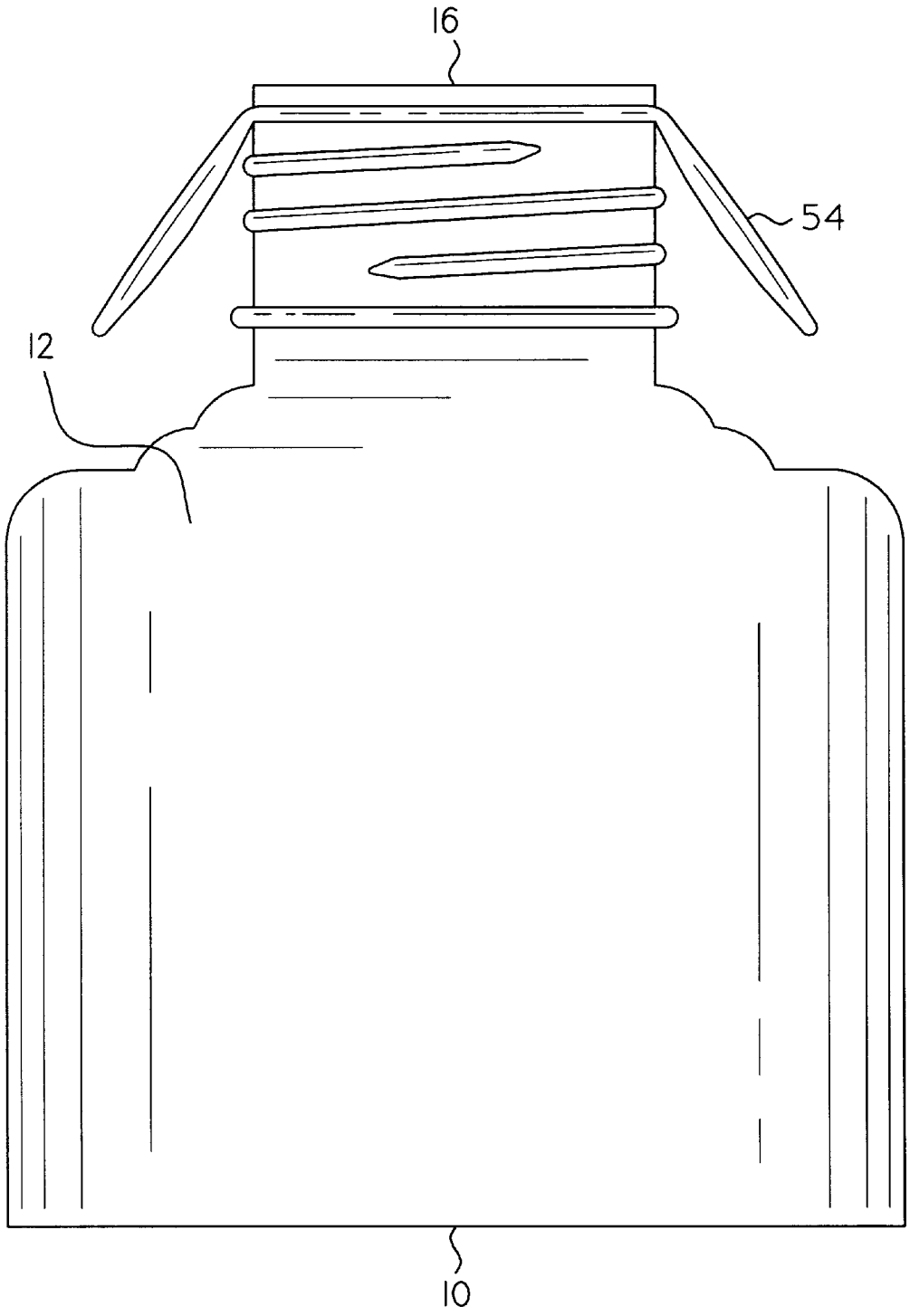

In an exemplary embodiment, cover 54 can be a ring shape (FIGS. 5, 7) or a cone shape (FIGS. 6, 8). In another embodiment, cover 54 can be balloon like (not shown), expanding to fit over threads 18 and then contracting to provide a snug fit.

In still another embodiment, cover 54 can be of a material (not shown) to be heat shrunk over threads 18, using a hair dryer or other heat source to achieve the final fit.

Figure 9:
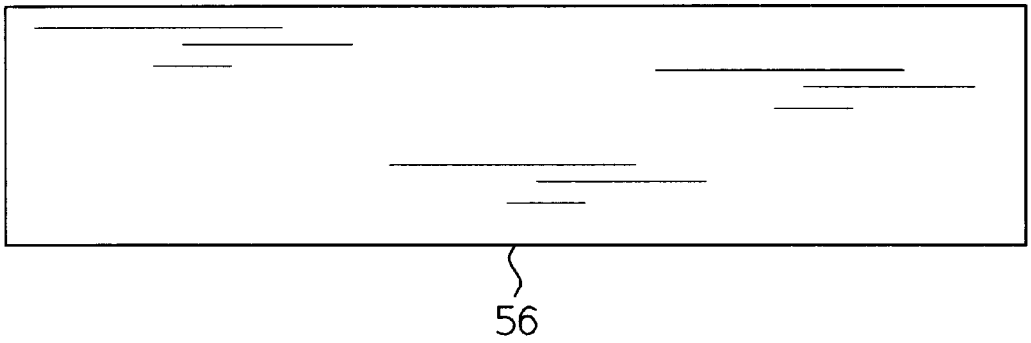

There is shown in FIG. 9 still another exemplary embodiment of the invention is shown. A non-stick strip 56 is designed to wrap around threads 18 as a supplementary coating. Strip 56 is tape like, having first and second sides and a substantially rectangular shape. When applied to a bottle neck 14 and threads 18, strip 56 molds to the contours of threads 18 and bottle neck 14 when closure 30 is secured onto bottle 10. Strip 56 can thus be described as cold moldable. Strip 56 provides a low cost, adaptable solution to sticking problems of uncoated bottles, such as nail polish bottles.

In still another embodiment, an adhesive layer can be applied to one side of strip 56 to provide additional adhesion of strip 56 to threads 18 and bottle neck 14. An exemplary strip 56 can be made form a tape material such as TEMP-R-TAPE HM430™ available from Furon, Inc., located in Housack Falls, New York. This tape is manufactured form a TEFLON film with an acrylic pressure adhesive.

While particular embodiments of the present invention have been disclosed herein, it is not intended to limit the invention to such disclosure and changes, modification or different embodiments may be incorporated within the scope of the following claims.

What is claimed:

1. A storage container for containing liquids that harden, comprising a body portion, a neck portion having an exterior threaded surface and a complimentary threaded closure wherein the threads of said exterior threaded surface are disposed around said neck portion and are coated with a non-stick coating to prevent said liquid that hardens from adhering to said threads and bonding said closure with said container; and wherein the non-stick coating comprises a tetrafluoroethylene fluorocarbon polymer resin.

2. A storage container in accordance with claim 1 wherein said storage container comprises a substantially circular neck portion and wherein said container; and wherein the non-stick coating comprises a tetrafluoroethylene fluorocarbon polymer resin are disposed around the circumference of said neck portion.

3. A storage container in accordance with claim 1 wherein said storage container is a nail polish container.

4. A storage container in accordance with claim 1 wherein said threaded container includes both exterior threaded and exterior non-threaded surfaces and is coated with said non-stick coating on said threaded and said non-threaded surfaces which can contact said closure.

5. A storage container in accordance with claim 1 wherein said closure comprises an insert having said complimentary threads and wherein said complimentary threads of said insert are coated with a non-stick coating comprising a tetrafluoroethylene fluorocarbon polymer.

6. A nail polish storage container comprising:

a body portion, a substantially circular neck portion having both exterior threaded and exterior non-threaded surfaces; wherein the threads of said exterior threaded surfaces are disposed around the circumference of said neck portion, said threaded and non-threaded surfaces coated with a coating comprising a tetrafluoroethylene fluorocarbon polymer; and a closure having threads complimentary to said threads of said threaded surface.

7. A nail polish storage container comprising:

a body portion, a substantially circular neck portion having both exterior threaded and exterior non-threaded surfaces; wherein the threads of said exterior threaded surfaces are disposed around the circumference of said neck portion, said exterior threaded and exterior non-threaded surfaces coated with a non-stick coating comprising a tetrafluoroethylene fluorocarbon polymer; and a closure having an insert having threads complimentary to said threads of said threaded surface, wherein said complimentary threads of said insert are coated with a non-stick coating comprising a tetrafluoroethylene fluorocarbon polymer.

8. A nail polish storage container comprising:

a body portion, a substantially circular neck portion having both exterior non-threaded surfaces; wherein the threads of said exterior threaded surfaces are disposed around the circumference of said neck portion, said exterior threaded and exterior non-threaded surfaces coated with a supplementary non-stick cover, having first and second sides, molded around said exterior threaded and non-threaded surfaces with said first side in contact with said threaded and non-threaded surfaces; wherein said non-stick coating comprises a tetrafluoroethylene fluorocarbon polymer.

9. A nail polish container in accordance with claim 8 wherein said first side of said supplementary non-stick cover is coated with an adhesive.

10. A glass storage container for containing liquids that harden comprising:

a body portion, a neck portion having an exterior threaded surface and a complimentary threaded closure; wherein the threads of said exterior threaded surface are disposed around said neck portion and are coated with a non-stick coating to prevent said liquid that hardens from adhering to said threads and bonding said closure with said glass container; and wherein said non-stick coating is a polyphenylene sulfide.

11. A glass storage container in accordance with claim 10 wherein said storage container comprises a substantially circular neck portion and wherein the threads of said exterior threaded surface are disposed around the circumference of said circular neck portion.

12. A glass storage container in accordance with claim 10 wherein said glass storage container is a nail polish container.

13. A glass storage container in accordance with claim 10 wherein said storage container includes both exterior threaded and exterior non-threaded surfaces and is coated with said non-stick coating on said exterior threaded and exterior non-threaded surfaces which can contact said closure.

14. A glass storage container in accordance with claim 10 wherein said closure comprises an insert having said complimentary threads and wherein said complimentary threads of said insert are coated with a non-stick coating comprising a polyphenylene sulfide.

15. A glass nail polish storage container comprising:

a body portion and a substantially circular neck portion having both exterior threaded and exterior non-threaded surfaces; wherein the threads of said exterior threaded surfaces are disposed around the circumference of said neck portion; said exterior threaded and exterior non-threaded surfaces coated with a non-stick coating comprising a polyphenylene sulfide; and a closure having threads complimentary to the threads of said exterior threaded surface.

16. A glass nail polish storage container comprising:

a body portion and a substantially circular neck portion having both threaded and non-threaded exterior surfaces, wherein the threads of said exterior threaded surfaces are disposed around the circumference of said neck portion, said exterior threaded and exterior non-threaded surfaces coated with a non-stick coating comprising a polyphenylene sulfide; and a closure having an insert having threads complimentary to said threads of said exterior threaded surface, wherein said complimentary threads of said insert are coated with a non-stick coating comprising a polyphenylene sulfide.

* * * * *